US006531950B1

(12) United States Patent
Becker et al.

(10) Patent No.: US 6,531,950 B1
(45) Date of Patent: Mar. 11, 2003

(54) ELECTRICAL DEVICES CONTAINING CONDUCTIVE POLYMERS

(75) Inventors: Paul N. Becker, San Carlos, CA (US); James A. Rinde, Fremont, CA (US); Barry C. Mathews, Fremont, CA (US); Orion Jankowski, Stanford, CA (US); Cecilia A. Walsh, Minnetonka, MN (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/606,821

(22) Filed: Jun. 28, 2000

(51) Int. Cl.[7] ..... H01C 7/13
(52) U.S. Cl. ..... 338/22 R; 338/324; 338/328
(58) Field of Search ..... 338/22 R, 324, 338/328

(56) References Cited

U.S. PATENT DOCUMENTS

| | | | | |
|---|---|---|---|---|
| 3,858,144 | A | 12/1974 | Bedard et al. | 338/22 R |
| 4,237,441 | A | 12/1980 | van Konynenburg et al. | 338/22 R |
| 4,304,987 | A | 12/1981 | van Konynenburg | 219/553 |
| 4,426,633 | A | 1/1984 | Taylor | 338/25 |
| 4,482,801 | A | 11/1984 | Habata et al. | 219/540 |
| 4,514,620 | A | 4/1985 | Cheng et al. | 219/553 |
| 4,534,889 | A | 8/1985 | van Konynenburg et al. | 252/511 |
| 4,545,926 | A | 10/1985 | Fouts et al. | 252/511 |
| 4,689,475 | A | 8/1987 | Kleiner et al. | 219/553 |
| 4,724,417 | A | 2/1988 | Au et al. | 338/22 R |
| 4,774,024 | A | 9/1988 | Deep et al. | 252/511 |
| 4,800,253 | A | 1/1989 | Kleiner et al. | 219/553 |
| 4,857,880 | A | 8/1989 | Au et al. | 338/22 R |
| 4,884,163 | A | 11/1989 | Deep et al. | 361/58 |
| 4,907,340 | A | 3/1990 | Fang et al. | 29/610.1 |
| 4,924,074 | A | 5/1990 | Fang et al. | 219/548 |
| 4,935,156 | A | 6/1990 | van Konynenburg | 219/553 |
| 5,049,850 | A | 9/1991 | Evans et al. | 338/22 R |

(List continued on next page.)

FOREIGN PATENT DOCUMENTS

| | | |
|---|---|---|
| DE | 3707494 A | 3/1988 |
| EP | 0952590 A | 10/1999 |
| EP | 0952591 A | 10/1999 |
| JP | 62-113402 | 5/1987 |
| JP | 4-18681 | 3/1992 |
| JP | 2698995 | 9/1997 |
| WO | WO95/34081 | 12/1995 |
| WO | WO97/45845 | 12/1997 |
| WO | WO 99/05689 | 2/1999 |

OTHER PUBLICATIONS

International Search Report for International Application No. PCT/US01/02600 dated May 11, 2001.

P. deGroot and L. Deek, J. Modern Optics, 1995, vol. 42, pp. 389–401.

International Search Report for International Application No. PCT/US01/20601 dated Jul. 29, 2002.

*Primary Examiner*—Karl D. Easthom

(57) ABSTRACT

An electrical device in which an element composed of a conductive polymer composition is positioned in contact with the first surface of a metal electrode, the first surface having a center line average roughness $R_a$ and a reflection density RD, the product $R_a$ times RD being at least 0.06 $\mu$m, with an adhesion promoting layer positioned between the first surface of the metal electrode and the polymer element. The conductive polymer composition preferably exhibits PTC behavior. In other aspects, electrical devices using more than one adhesion promoting layer, and electrical devices using an adhesion promoting layer in combination with a crosslinking agent are provided. Other embodiments include electrical devices with metal electrodes made by pulse plating processes, and metal electrodes made by electrodeposition under diffusion-limited conditions. The electrical devices may be circuit protection devices and have improved electrical and physical properties.

19 Claims, 1 Drawing Sheet

U.S. PATENT DOCUMENTS 5,250,228 A 10/1993 Baigrie et al. ..... 252/511
5,280,263 A * 1/1994 Sugaya ..... 338/22 R
5,286,527 A 2/1994 Blum et al. ..... 427/407.1
5,378,407 A 1/1995 Chandler et al. ..... 252/513
5,451,919 A 9/1995 Chu et al. ..... 338/22 R
5,582,770 A 12/1996 Chu et al. ..... 252/511
5,691,689 A * 11/1997 Smith et al. ..... 338/22 R
5,747,147 A 5/1998 Wartenberg et al. ..... 428/209
5,801,612 A 9/1998 Chandler et al. ..... 338/22 R
5,831,510 A 11/1998 Zhang et al. ..... 338/22 R
5,852,397 A 12/1998 Chan et al. ..... 338/22 R
5,856,771 A 1/1999 Chandler et al. ..... 338/22 R
5,864,280 A 1/1999 Hall ..... 338/22 R
5,864,281 A 1/1999 Zhang et al. ..... 338/22 R
5,874,885 A 2/1999 Chandler et al. ..... 338/22
5,880,668 A 3/1999 Hall ..... 338/22 R
5,908,542 A * 6/1999 Lee et al. ..... 205/152
5,940,958 A * 8/1999 Shaw, Jr. et al. ..... 338/22 R
5,955,936 A 9/1999 Shaw, Jr. et al. ..... 338/22 R
6,086,743 A * 7/2000 Ameen et al. ..... 205/183
6,104,587 A * 8/2000 Banich et al. ..... 361/106
6,157,289 A * 12/2000 Kojima et al. ..... 338/22 R
6,157,298 A 12/2000 Kojima et al. ..... 338/22 R
6,248,401 B1 * 6/2001 Chiang et al. ..... 427/255.7
6,358,438 B1 3/2002 Isozaki et al. ..... 252/511

* cited by examiner

ELECTRICAL DEVICES CONTAINING CONDUCTIVE POLYMERS

BACKGROUND OF THE INVENTION

1. Field of the Invention

This invention relates to electrical devices comprising conductive polymer compositions, to methods of making such devices, and to circuits comprising such devices.

2. Introduction to the Invention

Electrical devices comprising conductive polymer compositions are well known. Such devices comprise an element composed of a conductive polymer. The element is physically and electrically connected to at least one electrode suitable for attachment to a source of electrical power. The factors determining the type of electrode used include the specific application, the configuration of the device, the surface to which the device is to be attached, the resistance of the device, and the nature of the conductive polymer. Among those types of electrodes that have been used are solid and stranded wires, metal foils, perforated and expanded metal sheets, porous electrodes, and conductive inks and paints. When the conductive polymer element is in the form of a sheet or a laminar element, metal foil electrodes that are directly attached to the surface of the conductive polymer, sandwiching the element, are particularly preferred. Examples of such devices are found in U.S. Pat. No. 4,426,633 (Taylor), U.S. Pat. No. 4,689,475 (Matthiesen), U.S. Pat. No. 4,800,253 (Kleiner et al), U.S. Pat. No. 4,857,880 (Au et al), U.S. Pat. No. 4,907,340 (Fang et al), U.S. Pat. No. 4,924,074 (Fang et al), U.S. Pat. No. 5,831,510 (Zhang et al), U.S. Pat. No. 5,852,397 (Chan et al), U.S. Pat. No. 5,864,281 (Zhang et al), and U.S. Pat. No. 5,874,885 (Chandler et al), the disclosures of which are incorporated herein by reference.

Metal foils having microrough surfaces can give excellent results when used as electrodes in contact with conductive polymers. U.S. Pat. No. 4,689,475 discloses the use of metal foils that have surface irregularities, e.g. nodules, which protrude from the surface by 0.1 to 100 $\mu$m and have at least one dimension parallel to the surface which is at most 100 $\mu$m. U.S. Pat. No. 4,800,253 discloses the use of metal foils with a microrough surface which comprises macronodules which themselves comprise micronodules. U.S. Pat. No. 5,874,885 discloses the use of a metal electrode made of more than one type of metal with particular surface characteristics. Other documents which disclose the use of metal foils having rough surfaces, but which do not disclose the characteristics of the foils, are Japanese Patent Kokai No. 62-113402 (Murata, 1987), Japanese Patent Kokoku H4-18681 (Idemitsu Kosan, 1992), and German Patent Application No. 3707494A (Nippon Mektron Ltd., 1988). U.S. Pat. No. 5,880,668 discloses the use of a modified polyolefin with a carboxylic acid derivative grafted onto the polymer in combination with certain foils. The disclosure of each of these documents is incorporated herein by reference.

Desired properties of electrode materials for conductive polymer devices include: a low contact resistance to the polymer, a strong bond which will survive extended and repetitive electrical and/or mechanical stresses and adverse environmental conditions such as extreme temperatures, temperature cycling and heat and humidity; compatibility with conventional fabrication techniques; and low cost.

SUMMARY OF THE INVENTION

We have found that improved electroding for conductive polymers can be accomplished by using foil having a combination of surface features making up the surface roughness which is in a range which is lower than that previously used, in combination with an adhesion promoting layer. Until now, the primary mechanism proposed for forming a good bond between conductive polymers and metal foils has been mechanical interlocking achieved by using a rough surface on the metal foil, wherein the surface of the foil is imbedded into the conductive polymer by heating the polymer above its melting point during the electroding process. The resulting devices can have low contact resistance and good electrical performance. However, we have found that improved performance can be achieved by fabricating devices with metal foils that have a surface having a surface roughness parameter described by the product of two characteristic measurements of surface properties, and using an adhesion promoting layer between that surface of metal foil and the conductive polymer. Devices made by the present invention demonstrate low electrical resistance indicating low contact resistance at the electrode-polymer interface, resistance stability following thermal cycling, and improved resistance stability during and following prolonged and repeated electrical stress.

$R_a$ is a measure of one aspect of surface roughness known as "center line average roughness," which relates to an average value of the height of protrusions from a surface and is further described below. The measurement of the average value of height of protrusions, however, does not give any information about the density, distribution, or nature of the protrusions (e.g. spiked, rounded, etc.). A measurement of the reflection density RD of the surface (described below) gives a value which relates to the amount of light reflected from a surface using fixed incident light parameters, and thus gives a measure of the amount of structure on the surface on a size scale comparable to the wavelength of the light (i.e., visible light, around 600 nm). A shiny smooth surface will give a low reflection density, as most of the light will be reflected. The combination of $R_a$ and RD can be used to describe the surface of a foil, and it is especially useful to multiply $R_a$ by RD to describe the surface of the foil.

Foils that have lower surface roughness characteristics than those previously used can be less expensive than those with higher surface roughness. In addition, lamination of viscous or highly filled conductive polymer composites using melt processing can be facilitated by the use of lower structure foils since it is easier to imbed features of smaller average height into the viscous composites. For example, a faster line speed can be allowed since less time is required for the polymer to flow around and fill in a structured foil surface. In a foil which has a surface which is relatively rough, it is possible that the conductive polymer composition will not fill in completely around the features of the foil surface, resulting in trapped air pockets which disrupt the electrical continuity and provide points of failure at the interface, especially under electrical stress or environmental aging. As disclosed in copending commonly assigned application Ser. No. 09/626,825, filed contemporaneously with this application, the disclosure of which is incorporated herein by reference, metal foils with a surface parameter described by the product $R_a$ times RD in a certain range make excellent electrodes for conductive polymer elements. We have found that foils with an even broader range of $R_a$ times RD can be used in combination with an adhesion promoting layer. The resulting bond is very strong mechanically, and there is no undesired increase in resistance which can occur when an adhesion promoting layer is used with some foils, forming contact resistance at the interface. Thus, the combination of foil and adhesion promoting layer of this invention provides devices which have low resistance (indicating low contact resistance), stable resistance following electrical stress, and stable resistance following aging. This allows the use of inexpensive low roughness foils which have been previously unusable because of their inability to form a robust bond to conductive polymers, especially highly filled or nonpolar polymers. The cost of production of devices with lower roughness foils can also be reduced because lamination speeds can be increased. Finally, the invention enables the effective lamination of conductive polymer compositions which do not flow effectively, such as compositions which have been crosslinked, or are extremely highly filled.

The use of coupling agents as adhesion promoters is well known. Coupling agents or adhesion promoters are used to make adhesive bonds between polymers and metal or glass. The bonds thus formed are able to withstand conditions such as high temperature, high humidity, and physical stress. For example, such adhesion promoters are widely used in the circuit board industry for adhering thin metal foil to insulating composite substrates. However, in such an application, in which the substrate is insulating, the quality of the electrical contact between the metal and the substrate is not important, as the substrate is functioning as a dielectric. Conversely, when applying electrodes to a conductive polymer for the purpose of making an electrical device, it is important that good electrical contact exist between the metal and the conductive paths within the polymer and that uniform electrical contact exist over the area of the electrodes. Furthermore, the metal-polymer junction must not have a substantially higher resistance than the bulk of the device, otherwise it can be a point of failure. Many approaches have been taken to fabricate conductive polymer devices that do not have a region of high resistance at the electrode/polymer interface. For example, treating the surface by plasma etching to remove a thin polymer rich layer or the use of conductive tie layers or conductive adhesives between the electrode and the conductive polymer is known. The use of amine- and carboxylic-acid containing materials at the electrode-polymer interface has been disclosed in U.S. Pat. No. 3,858,144 (Bedard et al) as a means of stabilizing the resistance of a conductive polymer containing electrical devices.

Coupling agents have also been used in conductive polymer formulations to enhance the interaction between conductive particles or other additives and a matrix polymer. See for example U.S. Pat. Nos. 4,774,024 and 4,884,163 (Deep et al.), the disclosure of which is incorporated herein by reference. It is disclosed in these patents that coupling agents used in the bulk of the material can improve the adhesion of the conductive polymer composite to the electrode. In that instance, however, the coupling agent is not expressly applied to the junction between the electrode and polymer. Japanese Patent No. 2698995 (TDK, 1998) discloses that a coupling agent can be applied to a metal electrode attached to a polymeric PTC element to improve the electrode-polymer bond strength, as measured by peel strength. However, a high peel strength, while indicative of some types of mechanical strength, is not indicative of a quality electrical connection between the electrode and the conductive polymer. That is, peel strength could not give an indication of a device's electrode-polymer contact resistance or its ability to withstand electrical stress. We have now made devices incorporating the use of a coupling agent in combination with certain metal foil electrode properties to adhere metal foil to a conductive polymer device that does not interrupt the electrical conductivity between the conductive pathways in the polymer material and the electrodes. The resulting device has low resistance indicating low contact resistance, and stable resistance following prolonged and repeated stresses.

In a first aspect this invention provides an electrical device comprising (A) an element which
  (1) has first and second surfaces, and
  (2) comprises a conductive polymer, and
(B) a first metal foil electrode which
  (1) comprises
    (a) a first surface having (i) a center line average roughness $R_a$ $\mu$m and (ii) a reflection density RD, such that the product $R_a$ times RD is at least 0.06 $\mu$m, and
    (b) a second surface, and
  (2) is positioned so that the first surface of the first electrode is in contact with the first surface of the conductive polymer element with a first adhesion promoting layer positioned therebetween.

In a second aspect, this invention provides a process for making an electrical device, the process comprising (A) providing an element comprising a conductive polymer composition,
(B) providing a first metal electrode having
  (1) a first surface having a center line average roughness $R_a$ and a reflection density RD such that the product $R_a$ times RD is at least 0.06 $\mu$m, and
  (2) a second surface,
(C) providing at least one adhesion promoting layer between the conductive polymer and the first surface of the first metal electrode, and
(D) securing the metal electrode to the conductive polymer with the adhesion promoting layer therebetween.

In a third aspect, this invention provides an electrical device comprising (A) an element comprising a conductive polymer composition,
(B) a metal electrode comprising
  (1) a base metal foil and
  (2) first and second surfaces, said first surface in contact with the element and comprising
    (a) protrusions having a maximum height of 1 $\mu$m, and
    (b) a reflection density RD of at least 0.6, and
(C) an adhesion promoting layer positioned between the first surface of the electrode and the element.

In a fourth aspect, this invention provides an electrical device comprising (A) an element comprising a conductive polymer composition,
(B) a metal electrode, the metal electrode comprising
  (1) a base metal foil,
  (2) a first surface which (a) comprises dendritic metal structures, and (b) is in contact with the element, and
  (3) a second surface, and
(C) an adhesion promoting layer positioned between the first surface of the metal electrode and the element.

In a fifth aspect, this invention provides an electrical circuit which comprises (A) a source of electrical power;
(B) a load; and
(C) an electrical device, e.g. a circuit protection device, of the first, third, or fourth aspect of the invention electrically connecting the source and the load.

BRIEF DESCRIPTION OF THE DRAWINGS

The invention is illustrated in the accompanying drawings, in which.

DETAILED DESCRIPTION OF THE INVENTION

Figure 1:
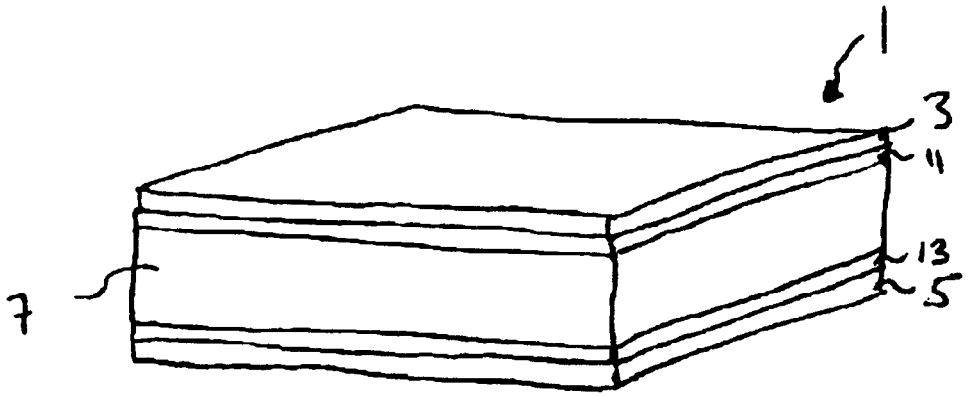
FIG. 1 shows the a plan view of a device of the invention.

Electrical devices of the invention are prepared from an element composed of a conductive polymer composition. The conductive polymer composition can be one in which a particulate conductive filler is dispersed in a polymeric component or matrix. Alternatively, the conductive polymer composition can comprise an intrinsically conducting polymer, such as polyaniline. The composition can exhibit positive temperature coefficient (PTC) behavior, i.e. it shows a sharp increase in resistivity with temperature over a relatively small temperature range, although for some applications the composition may exhibit zero temperature coefficient (ZTC) behavior. In this specification, the term "PTC" is used to mean a composition or device which has an $R_{14}$ value of at least 2.5 and/or an $R_{100}$ value of at least 10, and it is preferred that the composition or device should have an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. Generally the compositions used in the devices of the invention that exhibit PTC behavior show increases in resistivity which are much greater than those minimum values.

The PTC compositions used in the present invention are preferably conductive polymers that comprise a crystalline polymeric component and, dispersed in the polymeric component, a particulate filler component that comprises a conductive filler, e.g. carbon black or a metal. The filler component may also contain a non-conductive filler, which may change not only the electrical properties of the conductive polymer but also its physical and/or thermal properties. The composition can also contain one or more other components, e.g. an antioxidant, crosslinking agent, coupling agent, flame retardant, or elastomer. Suitable conductive polymers for use in this invention include those having a polymeric component which comprises polymers of one or more olefins, particularly polyethylene; copolymers of at least one olefin and at least one monomer copolymerisable therewith such as ethylene/ethyl acrylate, ethylene/acrylic acid, ethylene/vinyl acetate, and ethylene/butyl acrylate copolymers; melt-shapeable fluoropolymers such as polyvinylidene fluoride and ethylene/tetrafluoroethylene copolymers (including terpolymers); and blends of two or more such polymers. For some applications it may be desirable to blend one crystalline polymer with another polymer, e.g. an elastomer, an amorphous thermoplastic polymer, or another crystalline polymer, in order to achieve specific physical or thermal properties, e.g. flexibility or maximum exposure temperature. Electrical devices of the invention are particularly useful when the conductive polymer composition comprises a polyolefin because of the difficulty of bonding conventional metal foil electrodes to polyolefins, particularly nonpolar polyolefins. For applications in which the composition is used in a circuit protection device, it is preferred that the crystalline polymer comprise polyethylene, particularly high density polyethylene; and/or an ethylene copolymer; or a fluoropolymer. The polymeric component generally comprises 30 to 90% by volume, preferably 45 to 85% by volume, particularly 55 to 80% by volume of the total volume of the composition.

The particulate conductive filler which is dispersed in the polymeric component may be any suitable material, including carbon black, graphite, metal, metal oxide, conductive coated glass or ceramic beads, particulate conductive polymer, or a combination of these. The quantity of conductive filler needed is based on the required resistivity of the composition and the resistivity of the conductive filler itself. For many compositions, the conductive filler comprises 10 to 70% by volume, preferably 15 to 55% by volume, and particularly 20 to 45% by volume of the total volume of the composition. When used for circuit protection devices, the conductive polymer composition has a resistivity at 23° C. of less than 100 ohm-cm, preferably less than 10 ohm-cm, particularly less than 5 ohm-cm, especially less than 3 ohm-cm, e.g. 0.005 to 2 ohm-cm. The resistance at 23° C. of circuit protection devices is generally less than 100 ohms, preferably less than 10 ohms, particularly less than 1 ohm, e.g., less than 0.1 ohm. When the electrical device is a heater, the resistivity of the conductive polymer composition is generally higher, e.g. $10^2$ to $10^5$ ohm-cm, preferably $10^2$ to $10^4$ ohm-cm.

Dispersion of the conductive filler and other components may be achieved by melt processing, solvent-mixing, or any other suitable means of mixing. Following mixing the composition can be melt-shaped by any suitable method to produce the element. Suitable methods include melt-extruding, injection-molding, compression-molding, and sintering. For many applications it is desirable that the compound be extruded into sheet from which the element may be cut, diced, or otherwise removed. When the composition is melt-processed, some compositions may be very viscous, e.g. compositions made with high loading of conductive fillers or other fillers, or those made with relatively high molecular weight polymers. The specific energy consumption (SEC) of the compositions is an indication of their viscosity during processing. Useful compositions for electrical devices can exhibit a SEC in the range 0.5 MJ/kg to 4 MJ/kg, preferably 0.75 to 3 MJ/kg. The element may be of any shape, e.g. rectangular, square, or circular. Depending on the intended application, the composition may undergo various processing techniques, e.g. crosslinking or heat-treatment, following shaping or following attachment of electrodes. Crosslinking can be accomplished by chemical means or by irradiation, e.g. using an electron beam or a $Co^{60}\gamma$-irradiation source, and may be done either before or after the attachment of the electrode.

The conductive polymer element may comprise one or more layers of a conductive polymer composition. For some applications, e.g. where it is necessary to control the location at which a hotline or hotzone corresponding to a region where high current density forms, it is desirable to prepare the element from layers of conductive polymers which have different resistivity values.

Suitable conductive polymer compositions are disclosed for example in U.S. Pat. No. 4,237,441 (van Konynenburg et al), U.S. Pat. No. 4,304,987 (van Konynenburg), U.S. Pat. No. 4,514,620 (Cheng et al), U.S. Pat. No. 4,534,889 (van Konynenburg et al), U.S. Pat. No. 4,545,926 (Fouts et al), U.S. Pat. No. 4,724,417 (Au et al), U.S. Pat. No. 4,774,024 (Deep et al), U.S. Pat. No. 4,935,156 (van Konynenburg et al), U.S. Pat. No. 5,049,850 (Evans et al), U.S. Pat. No. 5,378,407 (Chandler et al), U.S. Pat. No. 5,451,919 (Chu et al), U.S. Pat. No. 5,582,770 (Chu et al), U.S. Pat. No. 5,747,147 (Wartenberg et al), and U.S. Pat. No. 5,801,612 (Chandler et al), and U.S. patent application Ser. No. 09/364,504 (Isozaki et al, filed Jul. 30, 1999), now U.S. Pat. No. 6,358,438. The disclosure of each of these patents and applications is incorporated herein by reference.

Devices of the invention comprise at least one electrode which is bonded to the conductive polymer element, using an adhesion promoting layer therebetween. Suitable adhesion promoting layers include coupling agents such as silane coupling agents, titanate coupling agents, and zirconate coupling agents. The coupling agent can be activated conventionally using thermal means, or by using radiation means such as by electron beam. Activation of the coupling agent can be accomplished simultaneously with other processing steps used in fabricating conductive polymer devices. For example, an electron beam commonly used to crosslink a conductive polymer composition will activate a coupling agent such as a styryl-containing agent or an amino-based composition. For thermally activated adhesion promoting layers, the heating conditions used to press-laminate foil to the conductive polymer can be used to simultaneously activate the adhesion promoting layer. Examples of suitable silane coupling agents which are especially useful in combination with a polyolefin- or fluoropolymer-based conductive polymer are styrene-based such as N-[2(vinylbenzylamino)-ethyl]-3-aminopropyl trimethoxysilane (e.g., Z6032 or Z6224, both available from Dow Coming; Z6224 is a low chlorine version of Z6032); γ-aminopropyl-trimethoxysilane (e.g., Z6011 available from Dow Coming); and 6-azidosulfonyl-hexyltriethoxysilane (available from Gelest). Other suitable coupling agents include silanes, zirconates, and titanates, e.g., (aminoethylaminomethyl)phenethyltrimethoxysilane, 4-aminobutyltriethoxysilane, 3-aminopropyltriethoxysilane, 3-(m-aminophenoxy)propyltri-methoxysilane, N-(6-aminohexyl)aminopropyltrimethoxysilane, N-(2-aminoethyl)-3-aminopropyltrimethoxysilane, bis (triethyoxsilyl)ethane, 3-methacryloxypropyltrimethoxysilane, vinyltrimethoxysilane, N-[3-triethoxysilyl) propyl-2-carbometh-oxyaziridine, neopentyl(diallyl)oxy, tri (m-amino)phenyl titanate, neopentyl(diallyl)oxy, tri(N-ethylenediamino) ethyl titanate (e.g., Lica 44 from Kenrich Petrochemicals), neopentyl(diallyl)oxy, tri(N-m-amino) phenyl zirconate (e.g., NZ 97 from Kenrich Petrochemicals), neopentyl(diallyl)oxy, tri(N-ethylenediamino ) ethyl zirconate (e.g., NZ 44 available from Kenrich Petrochemicals), and neopentyl(diallyl)oxy, diparamino benzoyl zirconate (e.g., NZ 37 available from Kenrich Petrochemicals). Other suitable coupling agents or adhesion promoting layers include peroxides, used alone or in combination with another material.

In some instances it is advantageous to use more than one adhesion promoting layer at a single polymer-electrode interface. For example, one adhesion promoting layer can be chosen to have optimal interaction with the metal electrode, and another chosen to have a good bond with the conductive polymer. Combinations of adhesion promoting layers can provide superior resistance to harsh environmental aging conditions such as a warm acidic environment. Alternatively, more than one type of adhesion promoting material can be used in a single layer to achieve desired properties. In addition, an adhesion promoting layer can be used in conjunction with a crosslinking agent. The crosslinking agent can interact with the surface of the conductive polymer, as well as the coupling agent. Suitable crosslinking agents include peroxides and free radical initiators, e.g., dicumyl peroxide, benzocyclobutane, and 2,2'-azo-bis-isobutyrylnitrile (AIBN). The crosslinking agent can be activated subsequently to attaching the electrode to the polymer, or simultaneously with the attachment process. The crosslinking can be accomplished thermally, using radiation, e.g. x-ray, electron beam, gamma radiation, ultrasound, or any other suitable technique. In some device constructions which have a first electrode and a second electrode, it is desirable to use a different adhesion promoting layer at each of the electrodes. For example, if the conductive polymer element were layered, so that the composition at the top was different from the composition at the bottom, adhesion promoting layers optimal for each of the compositions could be chosen for the top and bottom electrodes.

The adhesion promoting layer covers at least 20%, preferably at least 40%, particularly at least 60% of the surface area of the polymer-metal interface which is to connected. It is particularly preferred that essentially 100% of the surface area be covered, although for some applications it may be desirable to leave some sections of the interface intentionally uncoated. For purposes of this determination, the surface area is calculated by measuring the perimeter of the device and calculating the area within the perimeter; the surface area does not include any surface area contributed by the roughness of the foil. The thickness of the layer is generally very small (e.g., approximately a monolayer) and can be difficult to determine. However, we have found that a concentration of 0.01 to 5% by weight in a carrier is preferred. The adhesion promoting layer can be applied by any suitable technique, e.g., dipping, brushing, printing, die-coating, or spraying. Any solvent or carrier is generally allowed to evaporate before the metal foil is attached to the conductive polymer element. It is important to keep the thickness of the adhesion promoting layer sufficiently low so that electronic conduction, measured by electrical resistance, is not impaired.

The electrode is generally in the form of a solid metal sheet, e.g. a foil, although for some applications, the electrode may be perforated, e.g. contain holes or slits. The electrode may comprise layers of different metals, or it may comprise a base layer made of a first metal, and a surface layer made of a metal or alloy which is either the same or different than the metal of the base layer. For many applications, it is preferred that the metal foil electrodes comprise nickel or copper, and in some instances it is preferred that the surface of the electrode contacting the conductive polymer element comprise nickel. For some applications, it is preferred to use rolled metal (e.g., nickel) as a base layer. For other applications, it is preferred to use copper as a base layer, with a nickel-flashed exterior surface. For many devices of the invention, it is preferred to use two electrodes, sandwiching the conductive polymer element.

The surface of the electrode may be relatively smooth or may be microrough. Microrough surfaces generally are those which have irregularities or nodules which protrude from the surface, e.g. by a distance of at least 0.03 $\mu$m. Each irregularity or nodule may be composed of smaller nodules. Such microroughness is often produced by electrodeposition in which a metal foil is exposed to an electrolyte, or by codeposition of particulates, but a microrough surface may also be achieved by removing material from a smooth surface, e.g. by etching, by chemical reaction on a smooth surface, by reverse plating, or by contacting a smooth surface with a patterned surface, e.g. by rolling, pressing, or embossing. Metal foils with relatively smooth surfaces have been historically difficult to effectively bond to conductive polymer compositions, especially if the conductive polymer composition has a high level of filler and/or comprises a non-polar polymer. However, we have found that microrough surfaces with certain characteristics can be effectively bonded to very highly filled conductive polymer compositions to make devices with excellent electrical and mechanical characteristics.

$R_a$, the center line average roughness, is defined as the arithmetic average deviation of the absolute values of the roughness profile from the mean line or center line of a surface. The value of the center line is such that the sum of all areas of the profile above the center line is equal to the sum of all areas below the center line, when viewed at right angles to the foil. Thus $R_a$ is a gauge of the height of the protrusions from the surface of the foil. Conventionally, measurements have been made using a Tencor P-2 profilometer, available from Tencor. In this specification $R_a$ has been measured using an interferometer, a Zygo Model NewView 100, available from Zygo. The measurement of surface properties can be dependent upon the method used. In one limit, the surface roughness can be described as fractal in nature, because smaller and smaller features can be resolved with different techniques. It is also important to describe the surface area which was interrogated to insure that the entire surface is correctly represented, rather than reflecting a value which describes a local area only. For these reasons, it is important to identify and specify the best tool for characterizing the surface type of interest. Measurements made using a profilometer involve dragging a stylus across a surface and can be affected and limited by the size and shape of the stylus, and the speed with which the stylus traverses the surface. For example, the stylus may be too large to resolve cleanly the valley between peaks, particularly in cases where the foil structure includes narrow deep trenches. An interferometer is an optical instrument and can detect features over a very broad range of sizes, e.g., submicrometer to many micrometers. The use of an interferometer to measure surface characteristics is described in the article by P. deGroot and L. Deek, J. Modem Optics, 1995, vol. 42, pp. 389–401, the disclosure of which is incorporated herein by reference. For the applications described herein, where the surfaces can contain small, closely spaced, and/or irregularly shaped features, it is found that the use of an interferometer can provide more accurate measurements. Therefore, $R_a$ is defined herein as that measured by an interferometer.

Another characteristic measure of the surface roughness is obtained by measuring RD, the reflection density, which is defined as [$\log_{10}$(100%/% reflected light)], for visible light in the range 400 to 700 nm. Thus a highly reflective surface will have a low RD, and a surface appearing black will have a high RD. Measurements of RD can be made with a Macbeth model RD-1232 ColorChecker™ densitometer with calibration against a black standard prior to the measurement. This instrument is designed for characterizing the reflectivity of surfaces which produce relatively few specular reflections. In order to characterize the reflectivity of surfaces exhibiting both specular and diffuse reflections, we have also used a GretagMacbeth™ model ColorEye™ XTH spectrophotometer.

Since $R_a$ generally does not provide information about the nature or number of features on the surface of the foil, it is useful to characterize the overall surface roughness of a foil by calculating the product $R_A$ times RD (i.e., $R_a$*RD), and defining the quantity of $R_a$*RD which is optimal for a bond with excellent electrical contact and mechanical strength. For instance, a foil which has features that have very low average height (i.e. low $R_a$, e.g., less than 0.5 $\mu$m) will achieve a good bond if the foil has a sufficiently high density of these features (i.e., high RD, e.g., greater than 1). Conversely, a similar foil with the same low $R_a$ will not achieve a good bond if the density of the features is not sufficiently high (RD too low, e.g., less than 0.4). For many applications of this invention, $R_a$*RD is at least 0.06 $\mu$m, preferably at least 0.10 $\mu$m, more preferably at least 0.12 $\mu$m, particularly at least 0.14 $\mu$m, especially at least 0.16 $\mu$m, and more especially at least 0.20 $\mu$m, e.g., at least 0.25 $\mu$m. For applications in which $R_a$*RD is at least 0.06 $\mu$m, it is preferred that the $R_a$ value be 0.1 to 3 $\mu$m, more preferably 0.1 to 2 $\mu$m, and particularly 0.1 to 1 $\mu$m, and it is preferred that RD be at least 0.4, more preferably at least 0.6, particularly at least 0.8, e.g., at least 1.0.

Foils which are useful for aspects of this invention can be made by starting with a base foil and adding material onto a surface of the base foil, for example, by deposition. The nature of the base surface of the base foil can be an important factor in determining the foil surface's final roughness properties. For example, if the base surface is the matte side of an electrolytic foil, then $R_a$ of the base surface itself can be significant, e.g., 0.5 $\mu$m or higher. Electrolytic foils are generally made by electrodepositing metal from a solution onto a rotating metal drum. The resulting foil has two sides, a relatively smooth side adjacent to the drum (i.e. the shiny side), and a rougher exterior side (i.e. the matte side). If nodules are deposited or grown onto the matte side of an electrolytic foil, they can be very large, often up to 20 $\mu$m. The addition of small features on top of such a base surface may not produce a measurable change in the foil $R_a$, as it could be dominated by the relatively high $R_a$ of the base surface. However, if the base surface were smooth, e.g., a rolled metal having an $R_a$ of approximately 0.3 $\mu$m, or less, then the addition of small features on top of a smooth base surface could modify $R_a$ of the foil as the base surface would not dominate. For some applications, including those of the second embodiment, in which small features are deposited onto a base surface, it is often preferred to have a base foil with a base surface which has an $R_a$ of at most 0.5 $\mu$m, preferably at most 0.45 $\mu$m, more preferably of at most 0.3 $\mu$m, such that the product $R_a$*RD is at least 0.10 $\mu$m, preferably at least 0.12 $\mu$m, more preferably at least 0.14 $\mu$m, especially at least 0.17 $\mu$m, e.g., at least 0.2 $\mu$m. When $R_a$ of the base surface of the base foil is at most 0.45 $\mu$m, it is often preferred that the finished foil has a surface which has an $R_a$ which is 0.1 to 0.6 $\mu$m and an RD which is at least 0.5. For example, it is possible to produce densely spaced, extremely small protrusions on a very smooth surface such as a rolled metal surface by depositing metal or alloy onto the surface. By using a controlled deposition onto a surface, it is possible to produce a foil with small protrusions (e.g., height 0.1 to 1 $\mu$m), or a relatively narrow distribution of protrusion heights. If the surface onto which the protrusions are deposited is relatively smooth, then the maximum peak height (base foil surface feature height plus deposited protrusion height) will be small (e.g., 0.1 to 2 $\mu$m). Additional advantages to those stated above for using foils with smaller features include reduced risk of electrical shorting in thin devices, and reduced contribution to total mass from the foil nodules, which may be important in some applications, e.g. battery applications, in which the size of the device is preferably small and the weight is important.

In other aspects, the present invention includes foils which can be made by two different processes that may produce the desired foil characteristics for good electrode materials for electrical devices comprising conductive polymers. One foil which is especially useful for some applications is a foil which is a base metal foil which has metal deposits preferably having a maximum height of 2 μm and an RD of at least 0.5, particularly a maximum height of 1 μm and an RD of at least 0.6, and especially a maximum height of 0.7 μm and an RD of at least 1. A process which can make a foil having these properties utilizes pulse plating conditions at frequencies in the range 10 to 1000 Hz to form adherent submicron metal deposits on the surface of a base metal foil. The resulting foil has a very high surface area (high RD, e.g. greater than 0.5, and in many cases greater than 1). This technique avoids the formation of very large nodules that are commonly produced by conventional electroplating techniques that employ the application of a continuous direct current (DC). Pulse plating at frequencies lower than 10 Hz is not preferred because the duration of the "on" portion of the cycle is long enough to create a concentration gradient where metal ions have been depleted at the solid/liquid interface, resulting in similar conditions to DC which can produce large deposits and ultimately large nodules. For frequencies higher than 1000 Hz, the "off" portion of the cycle is insufficiently long to allow the cathode potential to fully decay, and therefore electrodeposition continues to some degree during the "off" portion, again resulting in DC-like plating conditions.

Another type of foil which is useful in some applications has densely spaced, fine, dendritic features. When used as an electrode for an electrical device, this type of foil has the advantage that it can make good electrical contact with the conductive polymer element despite the fragile nature of the surface features, evidenced by very small or negligible contributions to the total device resistance. The resistance of the polymer element (Re) can be measured independently from that of the device (Rv). For example, for anisotropic samples, a method which induces an inductance with eddy currents can be used to provide a resistance measurement of the polymer element (Re) without an electrode. An instrument capable of this type of measurement is a MicRhosense™ 6035, available from ADE Corporation. Alternatively, a direct comparison can be made to the resistances of devices made with a polymer element sandwiched between two electrodes which are made from other electrode materials which are known to make good electrical contact with conductive polymers such as conductive ink (e.g., silver paint) or conventional foil electrodes such as those disclosed in U.S. Pat. No. 4,689,475. Good electrical contact (i.e., low contact resistance) is achieved for many applications when Rv is at most 10% higher than Re. For other applications (e.g. very low resistance devices or high power devices) it is preferred that Rv is at most 5% higher than Re, preferably that Rv is at most 1% higher than Re. This type of foil can be made by a process which includes the use of electrodeposition of metal onto a base foil layer using a high cathode potential, so that the electrodeposition takes place under diffusion-limited conditions. Under steady-state diffusion-limited conditions, the metal ion concentrations are depleted at the cathode surface, resulting in plating occurring preferentially at any protruding region (e.g., a cusp). The resulting foil has a very high surface area, with dendritic metal features on the surface, and appears dusty. In conventional applications, foils made by similar processes with similar features would generally be subjected to further processing to mechanically strengthen the surface. For example, an encapsulating layer would be used. However, it is found that the foil as produced without an encapsulating layer is useful as an electrode material despite its dusty or fragile appearance.

It is known that crosslinking of a conductive polymer element can improve stability, especially when the device is repeatedly or continuously powered. However, crosslinking of devices can lead to an undesired increase in resistance. In another aspect of the invention, it is found that by applying a crosslinking agent in addition to the adhesion promoting layer to the interface between the polymer and electrode, we can cause crosslinking to occur selectively at that interface, thereby strengthening the bond between the electrode and polymer, without incurring the resistance increase associated with crosslinking of the bulk device. Suitable crosslinking agents include peroxides (e.g., dicumyl peroxide), azo-compounds, and other radical initiators, e.g. AIBN, and strained ring hydrocarbons such as benzocyclobutane. The crosslinking agent can be activated subsequently to attaching the electrode to the polymer, or simultaneously with the attachment process. The crosslinking agent can be activated thermally, using radiation, ultrasound, or any other suitable technique. The application of a crosslinking agent to the interface between the electrode and the conductive polymer element is especially useful when the surface of the electrode in contact with the polymer element has an $R_a$*RD of at least 0.06 μm, preferably at least 0.1 μm, particularly at least 0.12 μm, especially at least 0.14 μm, e.g., at least 0.20 μm.

Figure 2:
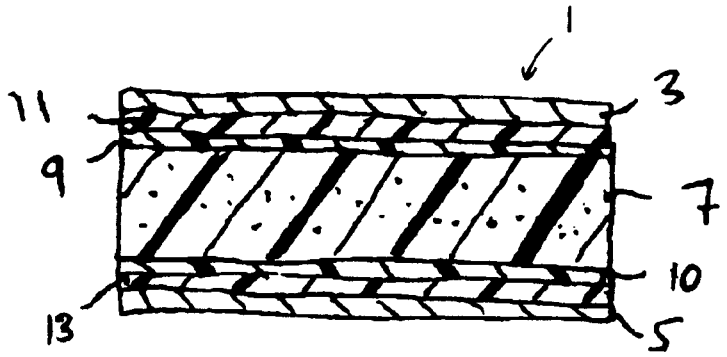
FIG. 2 shows a cross section of a device of another aspect of the invention.

The invention is illustrated by the following drawings in which FIG. 1 shows a plan view of an electrical device 1 of the invention in which first and second metal foil electrodes 3,5, respectively, are attached directly to a PTC conductive element 7 with first and second adhesion promoting layers 11,13 in between the polymer element 7 and electrodes 3,5, respectively. FIG. 2 is a cross-sectional view of a device of the invention including adhesion promoting layers 11,13 and crosslinking agent layers 9,10. Although both the adhesion promoting layers 11,13 and the crosslinking agent layers 9,10 are shown to be continuous across the surfaces of the polymer element and the electrodes, respectively, in the Figures, they need not be.

The invention is further illustrated by the following examples and comparative examples.

Examples 1 to 12

Use of an Adhesion Promoting Layer

A PTC conductive polymer composition was made by extruding pellets of a melt-processed conductive polymer composition containing 43% by volume carbon black (Raven™ 430, available from Columbian Chemicals) and 57% by volume high density polyethylene (Chevron 9659, available from Chevron) into sheets approximately 0.007 inch (0.18 mm) thick. Sheets were subdivided into sections. Sheets of metal foil as described in Table I were treated with 0.25% 6-azidosulfonylhexyltriethoxysilane (available from Gelest) in methyl ethyl ketone by dipping, and allowed to dry at room temperature and subsequently at 110° C. for 3 minutes. The foils were then press-laminated onto the polymer sheet sections at 200° C. at approximately 150 psi (10500 g/cm$^2$) for 4 minutes to form laminated sheets approximately 0.010 inch (0.25 mm) thick.

Table I lists the base foil, the foil thickness, the $R_a$, the RD, and the $R_a$*RD for each foil. Foil A was a rolled nickel foil. Foil B was the same as Foil T, except the shiny side of electrolytic copper foil with a nickel flash surface was bonded to the polymer. Foil C was the matte side of electrolytic nickel foil. Foil D was the shiny side of Foil V. Foil E was the shiny side of Foil C. Foils F and J were rolled Ni foils that had their surface which was in contact with the polymer etched with a ferric chloride etching solution, available from Kepro Circuit Systems. Foil G was rolled copper foil with a co-deposited nickel-copper nodule treatment (CopperBond Black™, available from Olin). Foils I, K, O, Q, R, T, and X were electrolytic copper foils where the matte side had been flashed with nickel and subsequently followed by a nickel nodule treatment, followed by a nickel flash layer on both sides. (The matte side was bonded to the polymer.) Foil V was the matte side of electrolytic copper foil with copper nodule treatment, followed by a nickel flash layer on both the nodular and shiny sides. Foil W was an electrolytic nickel foil with nickel nodules on the matte side (i.e. the side bonded to the polymer), available from Fukuda Metal Foil and Powder Co.

All $R_a$ values were measured using a Zygo interferometer using a typical scan area of 231 by 173 μm. The RD was measured using a MacBeth Model RD-1232 ColorChecker™ densitometer, except in the cases indicated, which were measured using a Gretag-MacBeth™ ColorEye™ XTH spectrophotometer which gave more accurate results for highly reflective surfaces. The Technical Association of the Pulp and Paper Industry (TAPPI) defines brightness as the reflectance at 45° at 457 nm. The spectrophotometer provided brightness values which were converted to RD values by use of a correlation curve. For reference, Table II shows a comparison of $R_a$ values measured by two different techniques, a surface profilometer or a Zygo interferometer, using the same samples of foil.

To measure the mechanical quality of the bond between the conductive polymer and the metal foil, peel strengths were measured on samples cut from the laminated polymer. One end of a 0.5 inch (12.7 mm) wide by 3 inch (76.2 mm) or longer sample was clamped in the jaws of an Instron 4501 testing apparatus and the foil was peeled off at a constant rate of 10 inches/minute (254 mm/minute) in a direction perpendicular to the surface of the sample (90 degree peel angle). The force in pounds/linear inch required to remove the foil from the conductive polymer was recorded. Results are shown in Table I, listed in order of the product $R_a$*RD. The peel results are typically an average of three measurements.

Individual pieces 0.25 inch (6.35 mm) in diameter were punched from the laminated sheets to form devices. As a measure of the electrical quality of the conductive polymer-metal bond, resistances were measured for the devices using a four-point probe at 23° C. to remove any extraneous contributions such as lead resistance and contact resistance to the probe. The results for the initial resistance, $R_i$, shown in Table I, are an average of ten devices. Also shown are the resistance values of devices after thermal cycling, i.e. heating the devices through twelve cycles from −40° C. to 85° C. (with a dwell time of 30 minutes at temperature and a ramp rate of 10° C./minute) before their resistances were measured at room temperature to give a final resistance, $R_f$.

Comparative Examples 13 to 24

Samples were prepared as in Examples 1–12, except without the use of the azido silane adhesion promoting layer. Results for the comparative examples are shown in Table III.

TABLE II

Comparison of $R_a$ measurements

| Foil Type | $R_a$ (profilometer) (μm) | $R_a$ (Zygo) (μm) |
|---|---|---|
| V[1] | 1.6[2] | 4.6 |
| T[1] | 1.6[3] | 3.2 |
| W | 1.6[3] | 3.2 |
| X[1] | 1.25[4] | 2.7 |
| R | 1.1[3] | 1.6 |
| Q | 0.85[3] | 1.34 |

[1]Foils V, T, and X are identified as "N2PO", "Type 31", and "Type 28", respectively, in U.S. Pat. No. 5,874,885.

[2]Measured using a Surtronic profilometer, available from Taylor Hobson, with a 5 μm radius stylus.

[3]Measured using a SE-40D profilometer, available from Kosaka Laboratory, Ltd., with a 2 μm radius stylus.

[4]Measured using a Tencor P-2 profilometer, available from Tencor, with a 5 μm radius stylus.

TABLE I

| Ex. No. | Foil Type | Base Foil | Foil thickness (μm) | $R_a$ (μm) | RD | $R_a$ * RD (μm) | Peel Strength (pli) [g/cm] | $R_i$ (ohm) | $R_f$ after 12 thermal cycles (ohm) |
|---|---|---|---|---|---|---|---|---|---|
| 1 | A | rolled Ni | 25 | 0.11 | 0.30[1] | 0.03 | 3.8 [679] | 1.27 | 4.50 |
| 2 | B | shiny side, electrolytic Cu | 38 | 0.21 | 0.30[1] | 0.06 | 1.0 [179] | 0.293 | 0.379 |
| 3 | C | matte side, electrolytic Ni | 20 | 0.44 | 0.28 | 0.12 | 2.1 [375] | 0.033 | 0.038 |
| 4 | D | shiny side, electrolytic Cu | 39 | 0.44 | 0.30[1] | 0.13 | 3.9 [697] | 0.079 | 0.079 |
| 5 | E | shiny side, electrolytic Ni | 29 | 0.45 | 0.33[1] | 0.15 | 3.9 [697] | 0.031 | 0.026 |
| 6 | F | rolled Ni | 24 | 0.55 | 0.42[1] | 0.23 | 1.9 [339] | 0.022 | 0.022 |
| 7 | G | rolled Cu | 35 | 0.18 | 1.42 | 0.26 | 4.4 [786] | 0.020 | 0.019 |
| 8 | I | matte side, electrolytic Cu | 32 | 0.79 | 0.37 | 0.29 | 4.5 [804] | 0.028 | 0.020 |
| 9 | J | rolled Ni | 22 | 1.08 | 0.40 | 0.43 | 1.8 [322] | 0.018 | 0.028 |
| 10 | K | matte, electrolytic Cu | 35 | 1.18 | 0.41 | 0.48 | 5.3 [946] | 0.020 | 0.015 |
| 11 | O | matte side, electrolytic Cu | 33 | 1.06 | 0.65 | 0.69 | 5.6 [1000] | 0.019 | 0.015 |
| 12 | V | matte side, electrolytic Cu | 39 | 4.60 | 0.93 | 4.28 | 7.1 [1268] | — | 0.014 |

[1]Measurement was made with a Gretag-MacBeth ™ ColorEye ™ XTH spectrophotometer. All others were made with a MacBeth ColorChecker ™, model RD-1232.

TABLE III

Comparative Examples

| Ex. No. | Foil Type | Base Foil | Foil thickness (μm) | $R_a$ (μm) | RD | $R_a$ * RD (μm) | Peel Strength (pli) [g/cm] | $R_i$ (ohm)[2] | $R_f$ after 12 thermal cycles (ohm) |
|---|---|---|---|---|---|---|---|---|---|
| 13 | A | rolled nickel | 25 | 0.11 | 0.30[1] | 0.03 | 0.2 [36] | >$10^6$ | — |
| 14 | B | shiny side, electrolytic Cu | 38 | 0.21 | 0.30[1] | 0.06 | 0.2 [36] | >$10^6$ | — |
| 15 | C | matte side, electrolytic Ni | 20 | 0.44 | 0.28 | 0.12 | 0[3] [0] | >$10^6$ | — |
| 16 | D | shiny side, electrolytic Cu | 39 | 0.44 | 0.30[1] | 0.13 | 0.2 [36] | >$10^6$ | — |
| 17 | E | shiny side, electrolytic Ni | 29 | 0.45 | 0.33[1] | 0.15 | 0.1 [18] | 0.133 | >$10^6$ |
| 18 | F | rolled Ni | 24 | 0.55 | 0.42[1] | 0.23 | 0.4 [71] | 0.028 | 0.215 |
| 19 | G | rolled Cu | 35 | 0.18 | 1.42 | 0.26 | 3.2 [572] | 0.018 | 0.017 |
| 20 | I | matte side, electrolytic Cu | 32 | 0.79 | 0.37 | 0.29 | 0.1 [18] | 0.564 | >$10^6$ |
| 21 | J | rolled Ni | 22 | 1.08 | 0.40 | 0.43 | 0.1 [18] | 0.023 | >$10^6$ |
| 22 | K | matte side, electrolytic Cu | 35 | 1.18 | 0.41 | 0.48 | 0.1 [18] | 0.023 | 0.956 |
| 23 | O | matte side, electrolytic Cu | 33 | 1.06 | 0.65 | 0.69 | 0.3 [54] | 0.019 | 0.015 |
| 24 | V | matte side, electrolytic Cu | 39 | 4.60 | 0.93 | 4.28 | 5.3 [947] | — | 0.013 |

[1]Measurement was made using a Gretag-MacBeth ™ ColorEye ™ XTH spectrophotometer. Others used the MacBeth ColorChecker ™, model RD-1232.
[2]>$10^6$ indicates the foil delaminated from the polymer so that no further measurement could be made.
[3]Could not be measured due to delamination.

The comparison of Examples 1 and 2 with Comparative Examples 13 and 14 shows that the use of the adhesion promoting layer improves peel strength for foils with a very low $R_a$*RD. However, the high resistances associated with Examples 1 and 2 show that a good electrical junction between the conductive polymer and the foil was not achieved with these foils. For foils with higher $R_a$*RD products, e.g. the foils of Examples 5 to 12, used in combination with a coupling agent, good electrical connection was made to the conductive polymer, evidenced by low resistance devices, and improved mechanical strength of the bond was achieved, by comparison with the respective comparative examples.

Examples 25 to 32

Use of Azido Silane With Low Roughness Foils to Enhance Cycle Life

Samples were prepared as in Examples 1–12, except the conductive polymer composition contained 42% by volume carbon black and 58% by volume polyethylene and was extruded into sheets of thickness 0.010 inch (0.25 mm). Examples 25 to 28 used an adhesion promoting compositions made from 6-azidosulfonylhexyltriethoxysilane in water, as shown in Table IV; Comparative Examples 29 to 32 were made without adhesion promoting layers. Foils Y and Z were electrolytic copper foils in which the matte side had been flashed with nickel and subsequently followed by a nickel nodule treatment, followed by a nickel flash layer on both sides. The laminated sheets were irradiated with an electron beam to 10 Mrads.

Individual devices were formed by punching 0.25 inch (6.35 mm) diameter disks from the laminated sheets. Each of these pieces was inserted into a metal leadframe, and was dipped into a solder bath at approximately 240° C. for 5 seconds to attach the lead frame to the device. Finally the devices were temperature cycled by heating and cooling between −40° C. and 85° C. twelve times as in Example 1. Cycle life over 900 cycles was measured as in Example 1. The results are shown in Table IV, showing an average of the number of devices tested. It is apparent that the stability of device resistance during cycle life was improved (as shown by a lower $R_f/R_i$ ratio) by the use of the adhesion promoting layer.

TABLE IV

| Ex. No. | Foil Type | $R_a$ (μm) | RD | Ra * RD (μm) | Adhesion Promoting Mixture | # of Devices | $R_i$ (ohm) | $R_f/R_i$ |
|---|---|---|---|---|---|---|---|---|
| 25 | T | 3.2 | 0.89 | 2.85 | 0.5% azido silane/water | 10 | 0.040 | 1.43 |
| 26 | X | 2.7 | 0.78 | 2.11 | 0.5% azido silane/water | 10 | 0.040 | 1.57 |
| 27 | Y | 3.0 | 0.91 | 2.73 | 0.1% azido silane/water | 5 | 0.040 | 1.41 |
| 28 | Z | 1.20 | 0.92 | 1.10 | 0.1% azido silane/water | 5 | 0.040 | 1.32 |
| 29* | T | 3.2 | 0.89 | 2.85 | None | 10 | 0.039 | 1.69 |
| 30* | X | 2.7 | 0.78 | 2.11 | None | 10 | 0.043 | 1.93 |
| 31* | Y | 3.0 | 0.91 | 2.73 | None | 5 | 0.039 | 1.49 |
| 32* | Z | 1.20 | 0.92 | 1.10 | None | 5 | 0.040 | 1.50 |

*Comparative Example

Examples 33 and 34

Use of Two Adhesion Promoting Layers

Sheets laminated with foil of type X were prepared as for Example 1, except that 42% by volume carbon black in 58% by volume high density polyethylene was used, sheets of thickness of 0.010 inch (0.25 mm) were prepared, and the azido silane (6-azidosulfonylhexyl-triethoxysilane, available from Gelest) was dissolved in methylethylketone (MEK). For Example 33 a second adhesion promoting layer, γ-aminopropyltrimethoxysilane in methanol, available from Huls, was applied to the foil. The adhesion promoting layers were applied in sequence, with the first adhesion promoting layer applied by dipping, allowed to dry at room temperature, and subsequently at 110° C. for 10 minutes, and then the second adhesion promoting layer was applied in the same manner. Strips of length at least 3 inches (76.2 mm) and 0.5 inch (12.7 mm) wide were cut from the laminated sheets and were irradiated to 10 Mrads, followed by heating for two cycles from room temperature to 160° C. and back to room temperature. Peel strengths for half the samples were then measured. The remaining samples were then immersed in a 1.5% solution of acetic acid at 85° C. for 24 hours, and final peel strengths were measured. Results are shown in Table V. Example 34 demonstrates that the use of a second adhesion promoting layer can improve peel strength and improve resistance to aging.

TABLE V

| Example | 1st adhesion promoting layer | 2nd adhesion promoting layer | Initial peel strength (pli) [g/cm] | Final peel strength (pli) [g/cm] | % change |
|---|---|---|---|---|---|
| 33 | 0.1% azidosilane/ MEK | none | 9.02 [1611] | 1.52 [271] | −83% |
| 34 | 0.1% azidosilane/ MEK | 0.1% γ-amino-propyl-trimethoxy silane/ methanol | 10.36 [1850] | 8.23 [1470] | −21% |

Examples 35 and 36

Use of a Crosslinking Agent in Combination With an Adhesion Promoting Layer

Conductive polymer sheets were prepared as in Example 1, using 42% by volume carbon black in high density polyethylene. For Comparative Example 35, Foil X was dip coated with 0.5% dicumyl peroxide in toluene and air dried for 10 minutes. For Example 36, Foil X was then dip coated with a solution of 0.5% N-[2(vinylbenzylamino)-ethyl]-3-aminopropyl trimethoxysilane (Z6224, a styryl silane coupling agent available from Dow Corning and having low chlorine) and 0.5% dicumyl peroxide in toluene, and then air dried for 10 minutes. The foils were then press laminated to the polymer sheet by hot pressing at about 150 psi (10500 g/cm$^2$) at 200° C. for 4 minutes. Strips of dimension 0.5 inch (12.7 mm) by 3 inch (76.2 mm) were cut and peel strengths were measured. Results are shown in Table VI.

TABLE VI

| Example | Crosslinking Solution | Adhesion Promoting Solution | Peel strength (pli) [g/cm] |
|---|---|---|---|
| 35* | 0.5% dicumyl peroxide/toluene | none | 1.69 [302] |
| 36 | 0.5% dicumyl peroxide/toluene | 0.5% Z6224/toluene | 4.33 [733] |

*Comparative example.

Examples 37 to 48

Use of Low Roughness Foil With Amino Silane Adhesion Promoter

Conductive polymer/foil laminates were prepared as in Example 1, except that the foils were dip-coated in an adhesion promoting mixture made up of 0.25% γ-aminopropyl-trimethoxysilane (Z6011) in water held at the temperature specified in Table VII. The laminated sheets were cut into two portions of roughly equal area. One portion was then crosslinked with a dose of 10 Mrads by electron beam. Individual pieces of 0.25 inch (6.35 mm) in diameter were punched from the laminated sheets and were thermally cycled as in Example 1. Device resistances were then measured at room temperature and the average resistance of the number of devices tested was calculated and is shown in Table VII. Peel strengths were measured by cutting the laminated sheets into 0.5 inch (12.7 mm) wide strips and following the procedure described in Example 1.

By using the amino silane adhesion promoting layer, it was possible to obtain low resistance devices using foil with $R_a$*RD as low as 0.06 μm. However, below this value (Foil A) the devices had high contact resistance even though the adhesion (peel strength) was good. Without any adhesion promoting layer, foils in Comparative Examples 13 to 17 delaminated from the devices except at a very high $R_a$*RD value (Example 24). Crosslinking increased peel strength and lowered device resistance.

TABLE VII

| Ex. No. | Foil Type | Ra * RD (μm) | Mixture Temp. (° C.) | Dose (Mrad) | Peel Strength (pli)/[g/cm] | # of Devices | $R_f$ after 12 thermal cycles (ohm) |
|---|---|---|---|---|---|---|---|
| 37 | A | 0.03 | 80 | 0 | 2.2 [393] | 9 | 3.57 |
| 38 | A | 0.03 | 80 | 10 | 3.2 [572] | 10 | 0.051 |
| 39 | B | 0.06 | 23 | 0 | 3.6 [643] | 10 | 0.096 |
| 40 | B | 0.06 | 23 | 10 | 4.1 [732] | 10 | 0.013 |
| 41 | C | 0.12 | 23 | 0 | 3.0 [536] | 10 | 0.023 |
| 42 | C | 0.12 | 23 | 10 | 3.9 [697] | 10 | 0.015 |
| 43 | D | 0.13 | 23 | 0 | 2.0 [357] | 10 | 0.066 |
| 44 | D | 0.13 | 23 | 10 | 3.8 [679] | 9 | 0.014 |
| 45 | E | 0.15 | 80 | 0 | 2.8 [500] | 10 | 0.025 |

TABLE VII-continued

| Ex. No. | Foil Type | Ra * RD (μm) | Mixture Temp. (° C.) | Dose (Mrad) | Peel Strength (pli)/[g/cm] | # of Devices | $R_f$ after 12 thermal cycles (ohm) |
|---|---|---|---|---|---|---|---|
| 46 | E | 0.15 | 80 | 10 | 3.7 [661] | 10 | 0.013 |
| 47 | I | 0.29 | 23 | 0 | 4.7 [839] | 10 | 0.020 |
| 48 | I | 0.29 | 23 | 10 | 5.1 [911] | 10 | 0.013 |

It will be understood that the above-described arrangements of devices and the methods described are merely illustrative of applications of the principles or this invention any other embodiments and modifications may be made without departing from the and scope of the invention as defined in the claims.

What is claimed is:

1. An electrical device comprising (A) an element which (1) has first and second surfaces, and (2) comprises a conductive polymer, and (B) a first metal foil electrode which (1) comprises (a) a first surface having (i) a center line average roughness $R_a$ μm and (ii) a reflection density RD, such that the product $R_a$ times RD is at least 0.06 μm, and (b) a second surface, and (2) is positioned so that the first surface of the first electrode is in contact with the first surface of the conductive polymer element with a first electrically nonconductive adhesion promoting layer positioned therebetween.

2. A device according to claim 1 wherein the product $R_a$ times RD is at least 0.10 μm.

3. A device according to claim 1 wherein $R_a$ is 0.1 to 3 μm and RD is at least 0.4.

4. A device according to claim 1 wherein the conductive polymer composition comprises a polymeric component and dispersed therein a particulate conductive filler.

5. A device according to claim 4 wherein the polymeric component comprises a polyolefin or a fluoropolymer.

6. A device according to claim 1 wherein the adhesion promoting layer comprises silane.

7. A device according to claim 6 wherein the adhesion promoting layer comprises azido silane or amino silane.

8. A device according to claim 1 wherein the conductive polymer composition exhibits PTC behavior.

9. A device according to claim 1 wherein the first metal foil electrode comprises nickel or copper.

10. A device according to claim 1 wherein the first surface of the first metal foil electrode comprises nickel or copper.

11. A device according to claim 1, further comprising (A) a second metal foil electrode comprising first surface and second surfaces, and (B) a second adhesion promoting layer positioned between the second surface of the conductive polymer element and the first surface of the second metal electrode, so that the conductive polymer element is sandwiched between the first and second metal foil electrodes.

12. A device according to claim 11 wherein the device is a circuit protection device which has a resistance of at most 100 ohms.

13. An electrical device according to claim 1 further comprising a crosslinking agent positioned between the first surface of the first metal electrode and the conductive polymer element.

14. A device according to claim 13, wherein the crosslinking agent comprises peroxide.

15. A device according to claim 1, wherein two different adhesion promoting layers are positioned between the first surface of the conductive polymer element and the first surface of the first electrode.

16. A device according to claim 1 wherein the first metal foil electrode is produced by (A) providing a base metal foil having a first surface having a center line average roughness $R_a$ of at most 0.45 μm, and (B) depositing material to provide protrusions onto the first surface of the base metal foil.

17. An electrical circuit which comprises (A) a source of electrical power;

(B) a load; and (C) a circuit protection device according to claim 1 electrically connecting said source and load.

18. An electrical device comprising (A) an element comprising a conductive polymer composition, (B) a metal electrode, the metal electrode comprising (1) a base metal foil, (2) a first surface which (a) comprises dendritic metal structures, and (b) is in contact with the element, and (3) a second surface, and (C) an electrically nonconductive adhesion promoting layer positioned between the first surface of the metal electrode and the element.

19. A device according to claim 18 wherein the metal electrode is produced by a process consisting essentially of (A) providing a base metal foil having a first surface and a second surface, and (B) depositing dendritic metal structures onto at least the first surface of the base metal foil by electrodepositing metal under diffusion limited conditions.

* * * * *